United States Patent [19]

Kelly et al.

[11] 4,193,553

[45] Mar. 18, 1980

[54] HAND-HELD SHOWER HEAD

[76] Inventors: Charles M. Kelly, 1016 St. Margarets Dr.; Francis C. Keffer, 1168 Summit Dr., both of Annapolis, Md. 21401

[21] Appl. No.: 849,213

[22] Filed: Nov. 7, 1977

[51] Int. Cl.[2] ..... B05B 1/18

[52] U.S. Cl. ..... 239/586; 239/525; 239/588

[58] Field of Search ..... 239/530, 588, 586, 525, 239/472; 251/321, 322, 335 A

[56] References Cited

U.S. PATENT DOCUMENTS

| | | | |
|---|---|---|---|
| 669,845 | 3/1901 | Melavin | 239/586 |
| 950,801 | 3/1910 | Barr | 251/322 X |
| 1,319,738 | 10/1919 | Watrous | 239/588 UX |
| 1,508,281 | 9/1924 | Kelly | 239/472 |
| 2,015,158 | 9/1935 | Rosenberg | 251/322 X |
| 2,596,387 | 5/1952 | Ellinger | 239/525 X |
| 3,445,069 | 5/1969 | Druge | 239/586 X |
| 3,588,040 | 6/1971 | Ward | 251/321 X |

FOREIGN PATENT DOCUMENTS

| | | | |
|---|---|---|---|
| 294006 | 3/1932 | Italy | 251/321 |

*Primary Examiner*—Robert W. Saifer

*Attorney, Agent, or Firm*—Schwartz, Jeffery, Schwaab, Mack, Blumenthal & Koch

[57] ABSTRACT

A hand-held shower head includes a housing which is cylindrical in shape and has a frusto-conical portion with a single orifice nozzle in the center thereof. A push-button actuator is positioned on the cylindrical side portion which in turn actuates a valve mechanism through a diaphragm seal. Water flows from an inlet opening through a lightly biased, normally closed valve which is operated through a plunger connected via the diaphragm to the push-button actuator, and out through a flow restricter and the single orifice nozzle. The push-button actuator is provided with stop means to limit the depression of the actuator.

7 Claims, 7 Drawing Figures

Fig. 1.
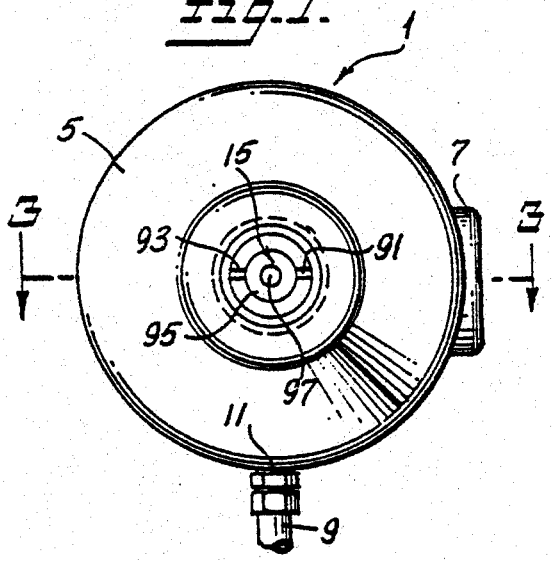
Fig. 2.
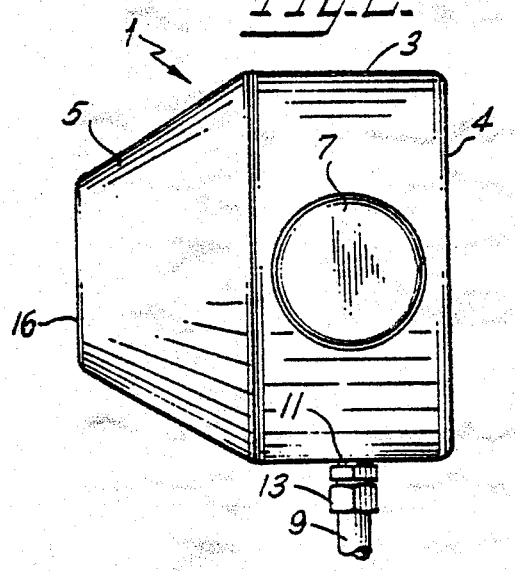
Fig. 3.
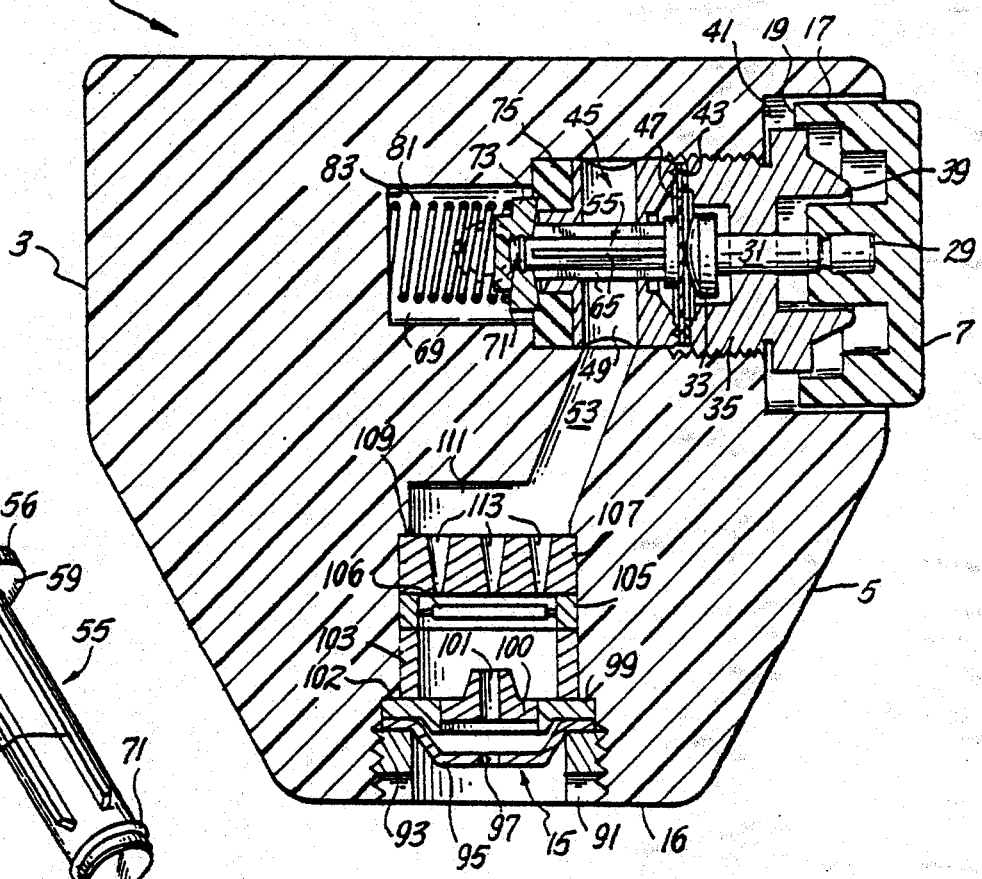
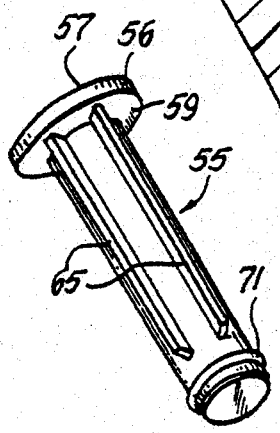
Fig. 8.

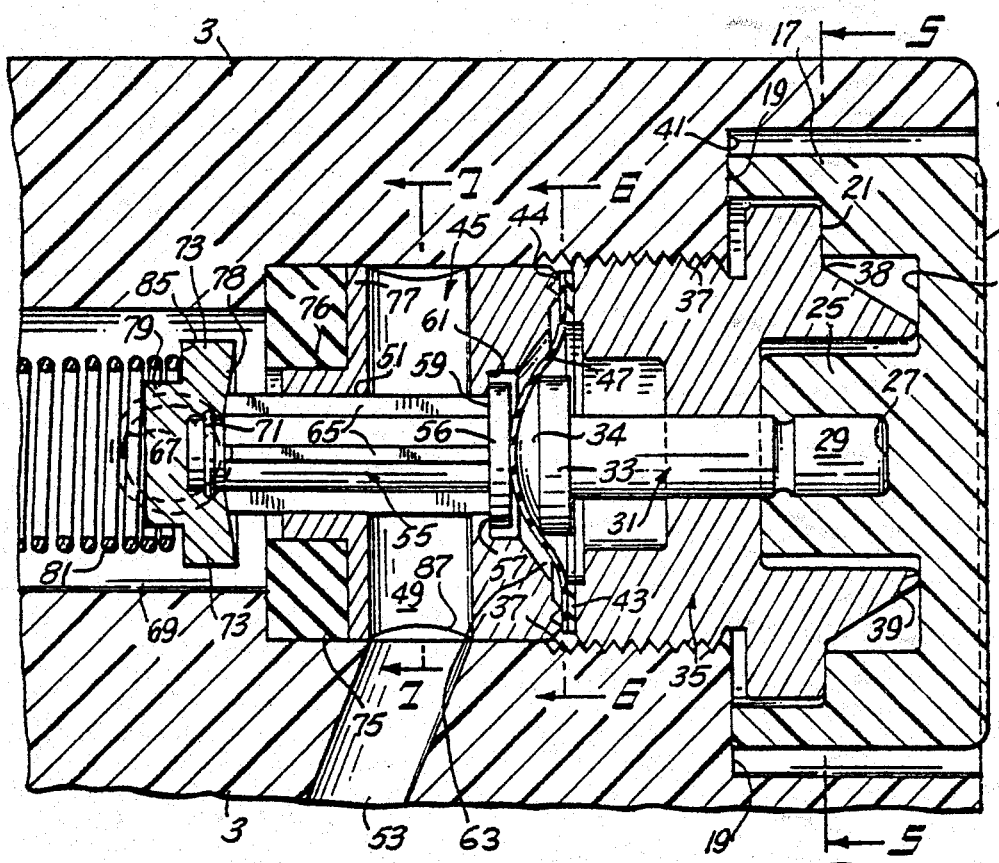
Fig. 4.
Fig. 6.
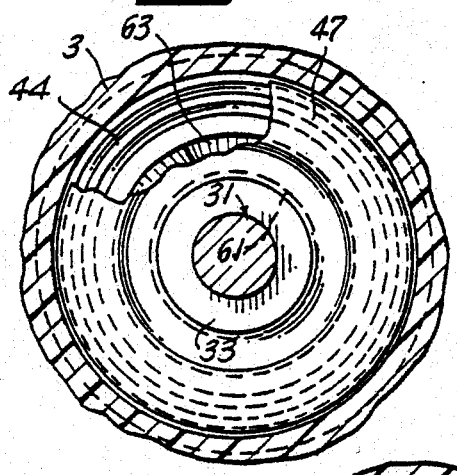
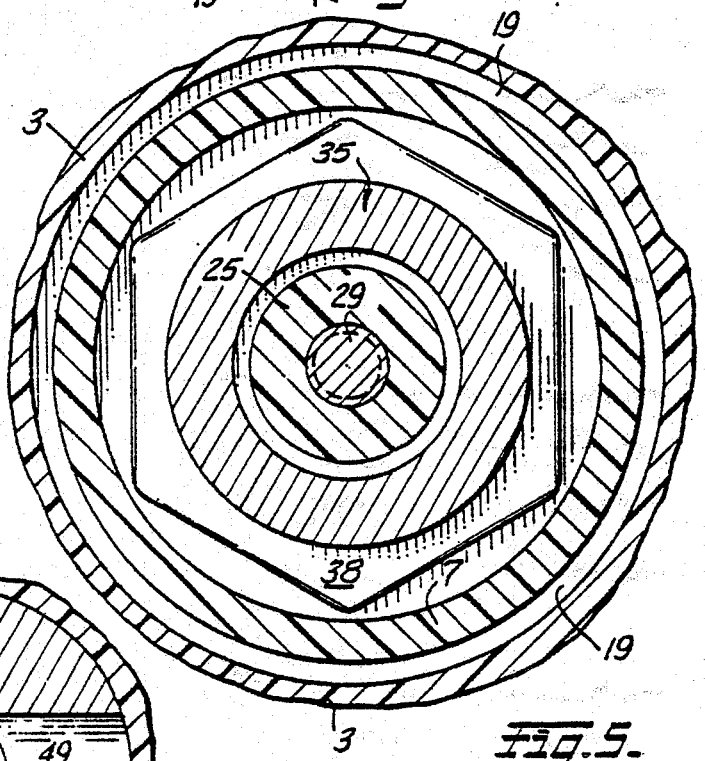
Fig. 5.
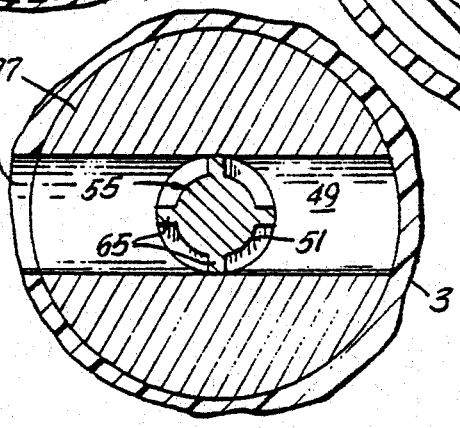
Fig. 7.

HAND-HELD SHOWER HEAD

BACKGROUND OF THE INVENTION

The present invention relates to a hand-held shower head, and more particularly to a flow reducing hand-held, portable shower head.

The prior art has included a large number of hand-held shower heads and kitchen sink sprays. These are normally of the "wand-type" as illustrated, for example, In U.S. Pat. No. 3,637,143. These "wand-type" mechanisms have the disadvantage of being difficult to use, and they normally have lever actuated valve mechanisms which are more susceptible to breakage.

Most prior art, hand-held shower heads, and shower heads in general, do not provide the means for conserving water.

SUMMARY OF THE INVENTION

It is an object of the instant invention to provide a durable hand-held shower head.

Another object is to provide a shower head with an actuator and valve mechanism that is extremely durable.

Still another object of the invention is to provide a water conserving shower head.

A further object is to provide a shower head with a single orifice which conserves water and at the same time provides a comfortable spray, as opposed to the harsh spray which occurs in those single orifice sprays now used in fixed installation showers for institutional and industrial usages.

Another object is to provide a shower head which is free of shaft seals and utilizes a diaphragm for sealing to prevent leakage.

The hand-held shower head of the instant invention includes a housing which is cylindrical in shape and has a frusto-conical portion with a single orifice nozzle in the center thereof. A push-button actuator is positioned on the cylindrical side portion which in turn actuates a valve mechanism through a diaphragm seal. Water flows from an inlet opening through a lightly biased, normally closed valve which is operated through a plunger connected via the diaphragm to the push-button acutator, and out through a flow restricter and the single orifice nozzle. The push-button actuator is provided with stop means to limit the depression of the actuator.

BRIEF DESCRIPTION OF THE DRAWINGS

The above and other objects and advantages of the present invention will become apparent from the following description taken in conjunction with the accompanying drawings wherein:

FIG. 4 is a further enlarged fragmentary horizontal sectional view, similar to FIG. 3, but showing the shower head valve in open position;

FIG. 5 is a fragmentary vertical sectional view, taken on the line 5—5 of FIG. 4;

FIG. 6 is a fragmentary vertical sectional view, taken on the line 6—6 of FIG. 4;

FIG. 7 is a fragmentary vertical sectional view taken on the line 7—7 of FIG. 4; and FIG. 8 is a perspective view of the plunger of the shower head valve.

DETAILED DESCRIPTION OF THE INVENTION

Figure 1:
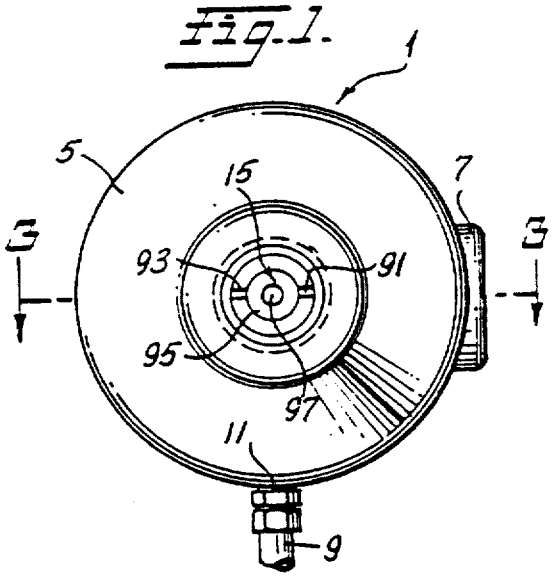
FIG. 1 is a front view of the hand-held shower head of the present invention.
Figure 2:
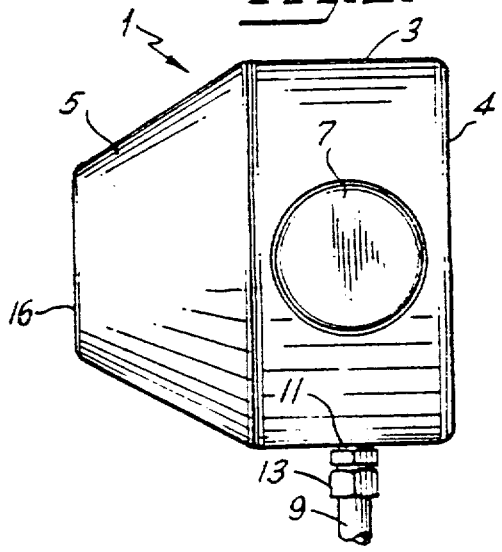
FIG. 2 is a side elevational view of the shower head of FIG. 1.

Referrring first to FIGS. 1 and 2 a hand-held shower head is seen having a body 1 including a cylindrical side portion 3, with rear wall portion 4 and a tapered frusto-conical cone portion 5. A push-button valve actuator member 7 is positioned on the side of the cylindrical portion 3, and an inlet hose 9 is connected into an opening at 11 by means of a conventional connector 13. Both the actuator and the inlet are positioned on radii of the housing. Finally, a single orifice nozzle mechanism 15 is positioned in the center of a front wall 16 of the frusto-conical cone member 5.

Figure 3:
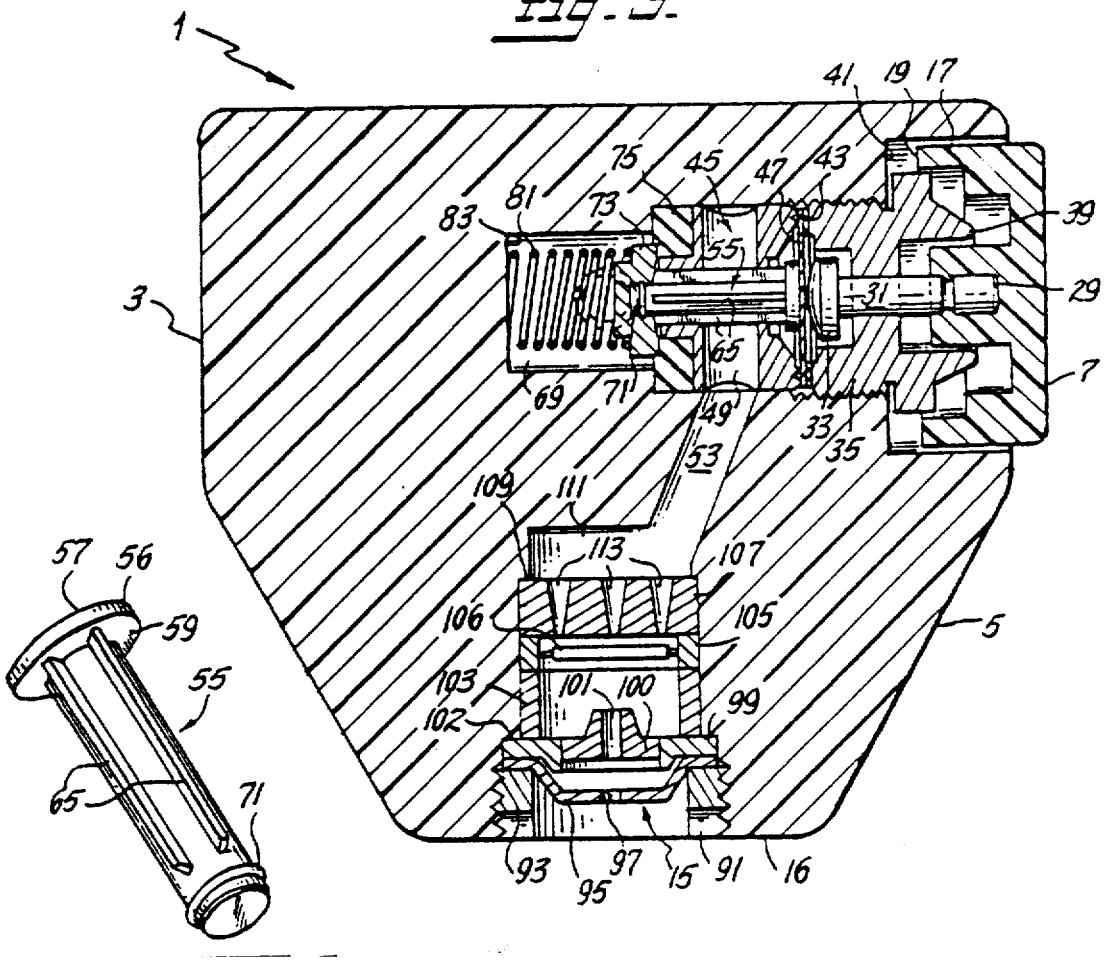
FIG. 3 is an enlarged horizontal sectional view, taken on the line 3—3 of FIG. 1 showing the shower head valve in closed position.

The push-button actuator member 7 and accompanying valve are seen in greater detail in FIGS. 3 and 4. FIG. 3 illustrates the valve mechanism in its normally closed position with the button actuator extended outwardly; whereas, FIG. 4 illustrates the button in the depressed position wherein the valve is in its open position permitting water to communicate with the nozzle 15.

The push-button actuator 7 includes a depending skirt portion 17 having a terminal edge 19, a first annular shoulder 21 and an annular rear shoulder 23. Further, there is a center portion 25 having an opening 27 therein which receives an end 29 of a stem 31 forming an extension portion on said actuator 7. The end 29 of stem 31 is press fitted into opening 27. A stem head 33 having a rounded edge portion 34 is positioned on the end of stem 31.

A hex-head shaped adapter 35 is secured by threading or other means 37 to the housing 3. The adapter includes an annular shoulder 38 to cooperate with annular shoulder 21 of the actuator as does a second annular shoulder 39 which can cooperate with shoulder 23 on actuator 7. As will be appreciated, the shoulders 21, 38 and lower edge 19 with a portion 41 on housing 3 (as well as 23, 39) provide the limits for the depression of actuator 7. By providing the various annular mating edges, it is possible to establish the maximum distance which actuator button 7 can extend into the housing. It has been found that by this particular mechanism the actuator button and the accompanying valve mechanism are almost indestructible.

A washer 43 is positioned at the end of the hex-head adapter 35. Between the washer 43 and a plurality of teeth 44 on a valve-distributor 45 is positioned a rubber diaphragm 47 which, as will be seen below, prevents any water from entering the adapter and push-button actuator portion of the shower head, thus preventing any leakage.

The valve distributor 45 includes a transverse bore opening 49 and an axial opening 51 therethrough. Transverse opening 49 communicates with a channel 53 extending toward nozzle mechanism 15 to be discussed below. Positioned in axial opening 51 is a plunger 55 seen in detail in FIG. 8. The plunger has a head 56 with a top surface 57 which cooperates with the rounded edge portion 34 of the stem with the diaphragm 47 therebetween. A lower surface 59 on plunger head 56 cooperates with an annular surface 61 on the adapter at the left-hand side of an open area 63 receiving the stem, plunger and diaphragm. The plunger has a plurality of positioning fins or vanes 65 which facilitate reciprocation of the plunger in opening 51. The remainder of the opening 51 between the vanes 65 serves as a water communication passage from inlet hose 9, through connector 13 and into a radial passage 67 and a spring chamber 69. The specific water flow will be discussed below.

At the end of the plunger 55 opposite head 56 is positioned a rib 71 to receive a valve bushing 73 press-fitted thereon. The bushing 73 acts as a valve closing member when cooperating with a resilient neoprene washer 75 forming a valve seat. Washer 75 is positioned around a cylindrical portion 76 on adapter 45, abutting an annular portion 77 and cooperating with a substantially concave or tapered shoulder portion 78. The edge of shoulder 78 provides positive seating against the softer washer member 75. The bushing 73 further includes a cylindrical portion 79 adapted to receive a spring 81 positioned in the chamber 69 and thus provides biasing between a lower surface 83 of chamber 69 and an annular shoulder 85 on bushing 73. The force of the spring is sufficient only to seat the valve bushing 73 at very low water pressures, normally under 5 psi. Thus, the compression rate of the spring is approximately 0.15 pounds per inch. As will be seen below it is essentially the water pressure in chamber 69 which holds the valve mechanism closed.

The adapter 45 includes a curved portion 87 in the transverse bore 49 adjacent flow line 53 to eliminate the need to precisely align the transverse bore 49 with the outlet 53. It is also possible to include a second transverse bore 90° to the illustrated bore 49 to facilitate water flow and alignment.

The outlet nozzle is positioned in the center of the frusto-conical cone portion 5 and includes a threaded opening 91 therein. A collar 93 threaded into opening 91 secures a spray orifice member 95 having a single opening 97 against a core member 99. The core member includes an insert 100 with a central opening 101 and four radial fan blade-type openings (not shown) therein. The core is secured between member 95 and a shoulder 102 in the housing. A spacing sleeve 103 is positioned between core 99, a containment ring 105 (having a diffuser 106 therein) and a conventional flow control device 107. The elements 103–107 are rigidly retained between core 99 and an annular ridge 109 adjacent a flow chamber 111 receiving water from channel 53. One or more openings 113 are located in the flow control device 107 to restrict the water flow to single orifice 97 through insert 100 in core member 99.

It will be appreciated that the single orifice nozzle mechanism is extremely important to the invention in that multiple orifice devices will not provide sufficient pressure unless the orifices are made sufficiently small. However, if one were to make the plurality of orifices small enough to equal the size of a single orifice, then they would become clogged with either small parts of debris which could possibly get into the shower water or more probably clogged by corrosion. Thus, it is possible, as will be appreciated from discussion elsewhere, to reduce flow even at household pressure wherein the nozzle will provide a spray of about 45° and will yield a good spray even at household pressures between 10 psi and up to as much as 120 psi. It has been found that the combination of the various elements spreads the spray out to the approximate 45° angle.

OPERATION

When the valve mechanism is in the position shown in FIG. 3, water pressure entering from inlet hose 9 exerts a pressure, in conjunction with the very slight pressure exerted by spring 81 against valve bushing 73 which closes the flow path to the outlet nozzle.

When the push-button actuator 7 is depressed as seen in FIG. 4, the surfaces 19 and 21 abut against surfaces 38 and 41, thus limiting the depression of the actuator. (Surface 39 can also abut against surface 23 to further insure the depth of depression of the actuator.) The actuator button 7 will be substantially flush with the cylindrical surface 3 of the housing 1.

By depressing actuator 7, stem 31 exerts a pressure through diaphragm 47 against plunger 55, which in turn, separates bushing 73 from the valve seat formed by washer 75. Water then flows in through radial opening 67, into chamber 69 and into the openings 51 between vanes 65 in plunger 55. The water then flows outwardly through the axial bore 49 into channel 53 and then into chamber 111. By means of flow controller 107 the flow is reduced and the water flows through the core 99 and out the single orifice 97. The fan blade openings impart a swirling action on the water passing therethrough which creates a spray cone leaving orifice 97. The water passing through opening 101 and out orifice 97 completes the spray pattern by "filling" the cone spray.

Thus, the operator has a hand-held shower unit which fits the palm of his hand and is easily actuated by push-button actuator 7. By constructing the housing with a durable nylon body and by constructing the push-button also of nylon, it is possible to have an extremely durable unit. By the specific structure of the valve and orifice mechanism, flow is reduced, and leakage is prevented through the utilization of the diaphragm 47. Further, the single orifice, accompanied by the flow restricter mechanism, provides a comfortable shower spray of about 45°. Thus, the invention provides a shower head which is at the same time, durable, reduces water flow and provides what might be termed a "conventional" spray pattern.

Finally, it is possible by merely depressing actuator 7 approximately halfway, thus opening the valve mechanism about halfway, to provide a pulsating spray.

While one embodiment of the invention has been described, it wil be understood that it is capable of many further modifications and this application is intended to cover any variations, uses, or adaptions of the invention and including such departures from the present disclosure as come within knowledge or customary practice in the art to which the invention pertains, and as may be applied to the essential features hereinbefore set forth and fall within the scope of the invention or the limits of the appended claims.

We claim:

1. A hand-held shower head comprising:

(a) a housing to be held in the hand, said housing having a side, a rear and a front, (b) an inlet positioned in said side, (c) an outlet spray nozxle in said front, (d) a passage in said housing connecting said inlet to said spray nozzle, (e) an opening substantially on a radius in said side, (f) a push-button actuator reciprocating in said side opening and having a portion extending into said housing, said housing including rigid means therein cooperating with at least two portions on said actuator for limiting the inward reciprocal movement of said actuator in said side opening, (g) a valve positioned in said passage and operatively connected to said actuator including:

(1) a normally closed movable valve member at least partially biased in the closed position against a valve seat by pressure exerted by water entering through said inlet, (2) a plunger connected to said movable valve member, and (3) sealing means cooperating with said plunger.

2. A hand-held shower head comprising:

(a) a substantially cylindrical housing to be held in the hand, said housing having a side, a rear and a front, (b) an inlet positioned substantially on a radius in said side, (c) an outlet spray nozzle in said front, (d) a passage in said housing connecting said inlet to said spray nozzle, (e) an opening located substantially on a radius in said side and positioned approximately 90° from said inlet, (f) a push-button actuator reciprocating in said opening and having a portion extending into said housing, (g) a valve positioned in said passage and operatively connected to said actuator including:

(1) a normally closed movable valve member at least partially biased in the closed position against a valve seat by pressure exerted by water entering through said inlet, (2) a plunger connected to said movable valve member, and (3) sealing means cooperating with said plunger, (h) whereby the shower head may be grasped in the hand of the user wherein the user's hand covers a portion of the rear and side of the shower head, surrounding the inlet and simultaneously actuating the push-button with thumb or finger.

3. A shower head as defined in claim 2 including means for reducing the flow of water positioned in said passage.

4. A hand-held shower head comprising:

(a) a substantially cylindrical housing including a frusto-conical cone portion thereon to be held in the hand, said housing having a side, a rear and a front, (b) an inlet positioned on a radius of said housing in said side, (c) an outlet spray nozzle in said front along an axis of said housing and on the face of said frusto-conical cone portion, (d) a passage in said housing connecting said inlet to said spray nozzle, (e) an opening on a radius of said housing in said side, (f) a push-button actuator reciprocating in said side opening and having a portion extending into said housing, (g) a valve positioned in said passage and operatively connected to said actuator including:

(1) a normally closed movable valve member at least partially biased in the closed position against a valve seat by pressue exerted by water entering through said inlet, (2) a plunger connected to said movable valve member, (3) a sealing diaphragm positioned between said plunger and said actuator portion.

5. A hand-held shower head comprising:

(a) a housing to be held in the hand, said housing having a side, a rear and a front, (b) an inlet positioned in said side, (c) an outlet spray nozzle in said front, (d) a passage in said housing connecting said inlet to said spray nozzle, (e) an opening in said side, (f) a push-button acutator reciprocating in said side opening and having a portion extending into said housing, (g) a valve positioned in said passage and operatively connected to said actuator including:

(1) a normally closed movable valve member at least partially biased in the closed position against a valve seat by pressure exerted by water entering through said inlet, (2) a plunger connected to said movable valve member, (3) a sealing diaphragm positioned between said plunger and actuator portion, (h) said valve including a valve distributor having a longitudinal, axial bore and a transverse bore therethrough, said bores intersecting and communicating with said inlet and said nozzle; said plunger being positioned in said longitudinal bore and having vanes thereon.

6. A shower head as defined in claim 5 including a resilient member positioned on said valve distributor and cooperating with said movable valve member, said movable valve member being of comparatively rigid material relative to said resilient member, and a spring lightly biasing said movable valve member into the closed position.

7. A hand-held shower head comprising:

(a) a housing to be held in the hand, said housing having a side, a rear and a front, (b) an inlet positioned in said side, (c) an outlet spray nozzle in said front, (d) a passage in said housing connecting said inlet to said spray nozzle, (e) an opening in said side, (f) a push-button actuator reciprocating in said side opening and having a portion extending into said housing, (g) a valve positioned in said passage and operatively connected to said actuator including:

(1) a normally closed movable valve member at least partially biased in the closed position against a valve seat by pressure exerted by water entering through said inlet, (2) a plunger connected to said movable valve member, (3) a sealing diaphragm positioned between said plunger and said actuator portion, (h) said nozzle is formed with a single orifice, (i) said passage includes means therein for reducing the flow of water, (j) said housing and said actuator include means for limiting the inward reciprocal movement of said actuator in said side opening, (k) said housing having a substantially cylindrical portion and including a substantially frusto-conical cone portion, said inlet and said actuator being positioned on radii of the housing, and said nozzle being positioned on the face of said frusto-conical cone portion and along the axis of said housing.

* * * * *

UNITED STATES PATENT AND TRADEMARK OFFICE

CERTIFICATE OF CORRECTION

PATENT NO. : 4,193,553

DATED : March 18, 1980

INVENTOR(S) : Charles M. Kelly et al

It is certified that error appears in the above—identified patent and that said Letters Patent is hereby corrected as shown below:

The 2 sheets of drawings should be deleted to insert the attached sheets of drawings respectively therefor.

THIS CERTIFICATE APPLYS TO THE GRANT EXCLUSIVELY.

Signed and Sealed this

*Second* Day of *September 1980*

[SEAL]

*Attest:*

SIDNEY A. DIAMOND

*Attesting Officer*

*Commissioner of Patents and Trademarks*

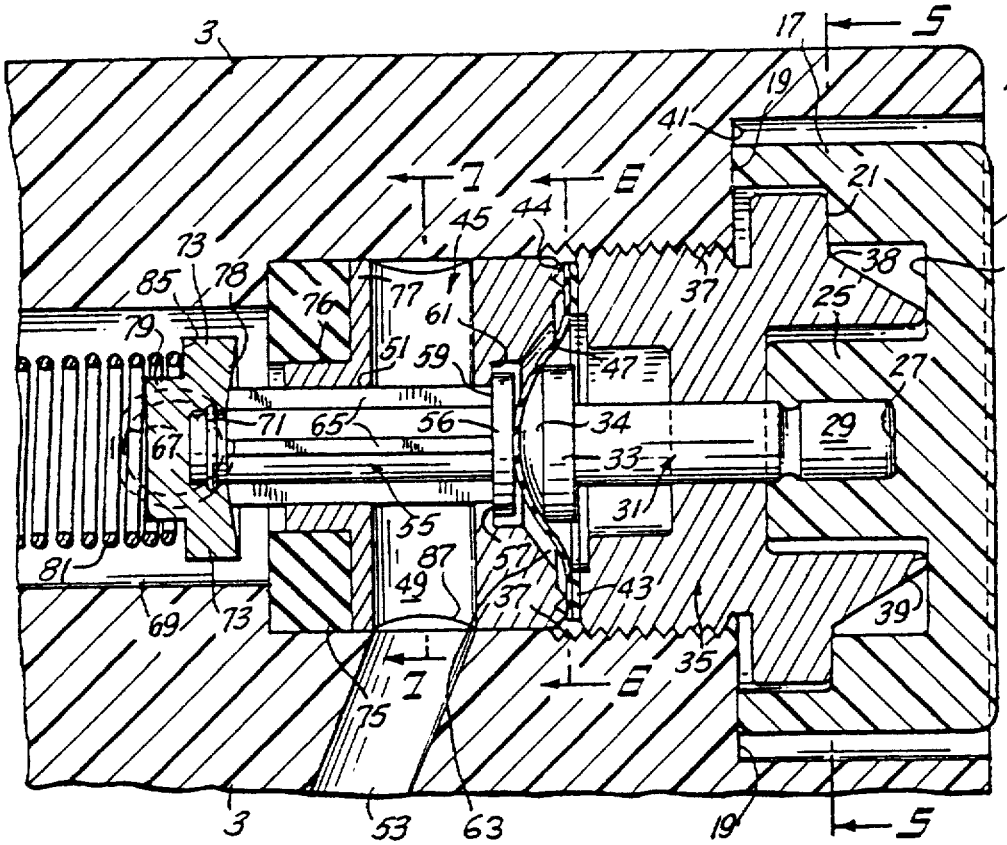
Fig. 4.
Fig. 6.
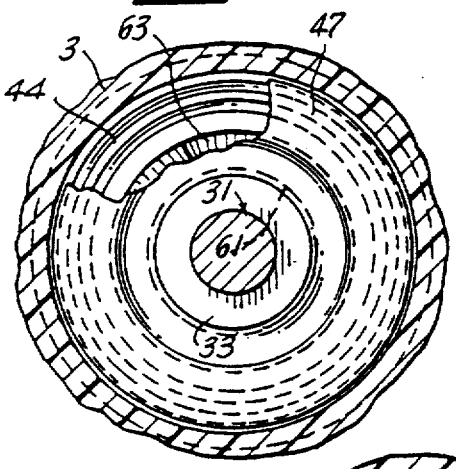
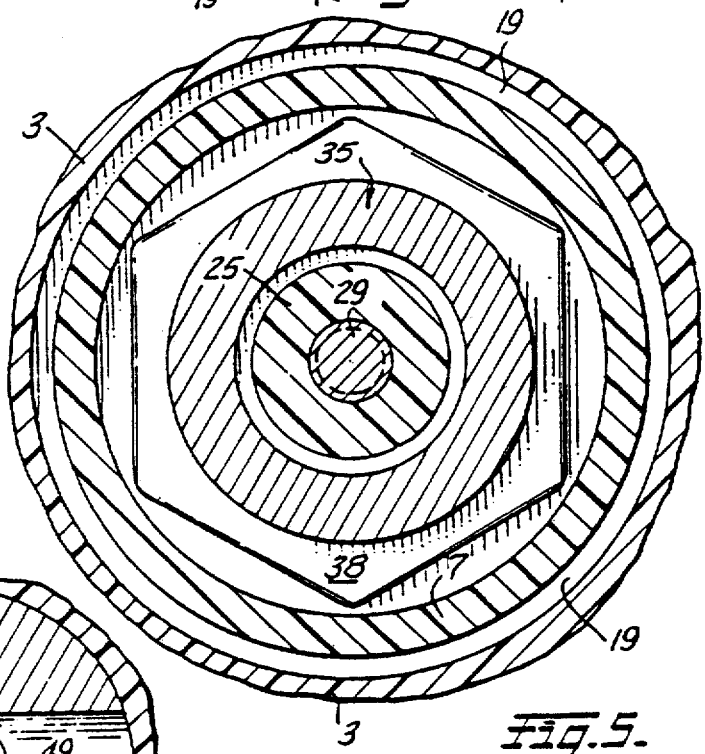
Fig. 5.
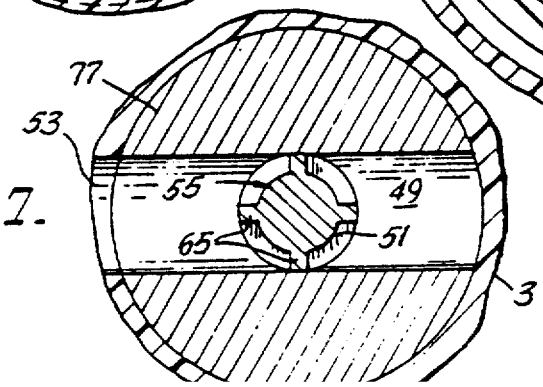
Fig. 7.